US009757949B2

(12) United States Patent
Yoshida et al.

(10) Patent No.: US 9,757,949 B2
(45) Date of Patent: Sep. 12, 2017

(54) LIQUID CONTAINER COUPLED TO A REFILL CONTAINER AND INK-JET RECORDING APPARATUS HAVING SAME

(71) Applicant: Hitachi Industrial Equipment Systems Co., Ltd., Chiyoda-ku, Tokyo (JP)

(72) Inventors: Naomichi Yoshida, Tokyo (JP); Akira Miyao, Tokyo (JP); Takehiko Matsushita, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 14/701,603

(22) Filed: May 1, 2015

(65) Prior Publication Data

US 2015/0231889 A1 Aug. 20, 2015

Related U.S. Application Data

(63) Continuation of application No. 14/319,868, filed on Jun. 30, 2014, now Pat. No. 9,050,814.

(30) Foreign Application Priority Data

Aug. 30, 2013 (JP) ..... 2013-178805

(51) Int. Cl.
*B41J 2/175* (2006.01)

(52) U.S. Cl.
CPC ..... *B41J 2/17506* (2013.01)

(58) Field of Classification Search
CPC B41J 2/17506; B41J 2/17509; B41J 2/17513; B41J 2/17553; B41J 2/175; B41J 2/17
See application file for complete search history.

(56) References Cited

U.S. PATENT DOCUMENTS 4,436,125 A * 3/1984 Blenkush ..... F16L 37/0841 137/797
5,971,532 A 10/1999 Toda
5,980,029 A * 11/1999 Hayao ..... B41J 2/17506 347/85
6,007,107 A * 12/1999 Kazarian ..... F16L 37/60 285/120.1

(Continued)

FOREIGN PATENT DOCUMENTS

CN 101298212 A 11/2008
CN 201604360 U 10/2010

(Continued)

OTHER PUBLICATIONS

Extended European Search Report dated Mar. 16, 2015 (eight (8) pages).

(Continued)

*Primary Examiner* — Matthew Luu
*Assistant Examiner* — Patrick King
(74) *Attorney, Agent, or Firm* — Crowell & Moring LLP

(57) ABSTRACT

A liquid container includes a coupling part that is configured to engage with a refill liquid container. The coupling part includes a pipe unit that, when the liquid container is in use, is projected upward in a vertical direction of the liquid container. The coupling part also includes a plane part that is disposed around the pipe unit.

6 Claims, 4 Drawing Sheets

(56) References Cited

U.S. PATENT DOCUMENTS

| | | | | |
|---|---|---|---|---|
| 6,499,719 | B1 * | 12/2002 | Clancy | F16L 37/23 251/149.6 |
| 7,758,566 | B2 * | 7/2010 | Simpson | A61M 5/3134 604/537 |
| 8,647,310 | B2 * | 2/2014 | Fangrow, Jr. | A61M 39/26 251/149.2 |
| 9,090,450 | B2 * | 7/2015 | Reimann | B67D 7/34 |
| 2003/0142176 | A1 | 7/2003 | Wu et al. | |
| 2006/0238583 | A1 * | 10/2006 | Petersen | B41J 2/17513 347/86 |
| 2008/0284833 | A1 | 11/2008 | Uehara et al. | |
| 2010/0147894 | A1 * | 6/2010 | Reimann | B67D 7/34 222/325 |
| 2010/0220129 | A1 | 9/2010 | Tomlin et al. | |

FOREIGN PATENT DOCUMENTS

| | | | |
|---|---|---|---|
| DE | 3401071 | A1 | 7/1985 |
| EP | 0 745 482 | A2 | 12/1996 |
| EP | 0 803 364 | A2 | 10/1997 |
| EP | 0 816 099 | A2 | 1/1998 |
| EP | 1 987 958 | A2 | 11/2008 |
| JP | 2011-500353 | A | 1/2011 |
| KR | 2003-0015837 | A | 2/2003 |
| WO | WO 98/03339 | | 1/1998 |
| WO | WO 03/016062 | A1 | 2/2003 |

OTHER PUBLICATIONS

Chinese Office Action issued in counterpart Chinese Application No. 201610523376.X dated May 27, 2017 with partial English-language translation (seven (7) pages).

* cited by examiner

LIQUID CONTAINER COUPLED TO A REFILL CONTAINER AND INK-JET RECORDING APPARATUS HAVING SAME

INCORPORATION BY REFERENCE

The present application is a continuing application of Ser. No.: 14/319,868, which was filed in the U.S. Patent and Trademark Office on Jun. 30, 2014, now issued U.S. Pat. No. 9,050,814 and which claims priority from Japanese application no.: JP-2013-178805 filed in the Japan Patent Office on Aug. 30, 2013, the disclosures of which are expressly incorporated by reference herein.

BACKGROUND OF THE INVENTION

The present invention relates to a liquid container and an ink-jet recording apparatus having the liquid container.

As the background concerning this invention, in cases where an attempt is made to refill the exhausted ink or solvent of an ink jet recording apparatus, an operator holds by hand a refill liquid container while letting its pourer be in the open state; so, when performing a pouring operation, a handling failure can occur, which leads to the risk of spilling the ink or solvent inside the liquid container.

Prior known techniques for avoiding this risk include a method having the steps of coupling the refill liquid container to an adapter on the ink system side while letting the container's liquid-sealing portion be in the closed state, opening this liquid seal portion after having established firm engagement, and then refilling the ink or solvent.

One prior art technology pertinent to this method is disclosed, for example, in JP-A-2011-500353. This patent literature involves the following recitation: "A method for measuring the volume of a liquid such as ink or solvent remaining within a storage vessel, such as a replacement cartridge used for continuous ink-jet printer, is arranged to use a reservoir surrounding the interior space having a variable volume for the storage use. This reservoir is designed to provide a decrease in internal space pressure, which substantially monotonously increases in significance when the liquid is drawn into the printer, enabling the volume of a residual liquid to be calculated from the information of a minimal extraction pressure required to draw a further liquid into the printer from the reservoir. The vessel used in the present invention has a small-amount liquid outlet port. This port is arranged to spout a liquid in small amounts when an extraction pressure of outside of the port is less than the internal space pressure and to prevent entry of air to the reservoir's internal space in process of performing the small-amount-at-a-time spouting of the liquid."

The above-stated JP-A-2011-500353 teaches only a mechanism of a method for refilling the exhausted ink or solvent of an ink jet printer. As suggested in JP-A-2011-500353, one appropriate approach to controlling small-amount liquid ejection while preventing the air from entering the reservoir's interior space is to arranging the port to have a self-sealing partition, which is pierced by a fine hollow tube or needle when a replacement cartridge is in use. The liquid is drawn out by a pump to flow through the tube, which is connected to the pump by liquid-tight engagement schemes.

In this case, however, the in-vessel liquid is drawn by the pump into the apparatus; so, depending on an installation position of the partition seal unit on the replacement cartridge side and/or a setting direction of the replacement cartridge to the reservoir, a certain quantity of liquid can remain inside the replacement cartridge after completion of the liquid refilling operation.

SUMMARY OF THE INVENTION

It is therefore an object of this invention to provide a liquid container capable of reducing the residual liquid inside a refill liquid container being coupled therewith during liquid-refilling and also provide an ink jet recording apparatus having the liquid container.

Although the invention disclosed herein involves a plurality of means for attaining the foregoing object, one example thereof is a liquid container coupled to a refill liquid container for refilling ink, which includes a coupling part for engagement with the refill liquid container, and a pipe unit disposed at the coupling part for being inserted into the refill liquid container to thereby permit inflow of a liquid, wherein a slit is provided at a leading end of the pipe.

In accordance with this invention, it is possible to provide a liquid container capable of reducing or minimizing the residual liquid in its associated refill liquid container being coupled therewith in process of liquid-refilling and an ink jet recording apparatus having the liquid container.

Other objects, features and advantages of the invention will become apparent from the following description of the embodiments of the invention taken in conjunction with the accompanying drawings.

DESCRIPTION OF THE EMBODIMENTS

Figure 1:
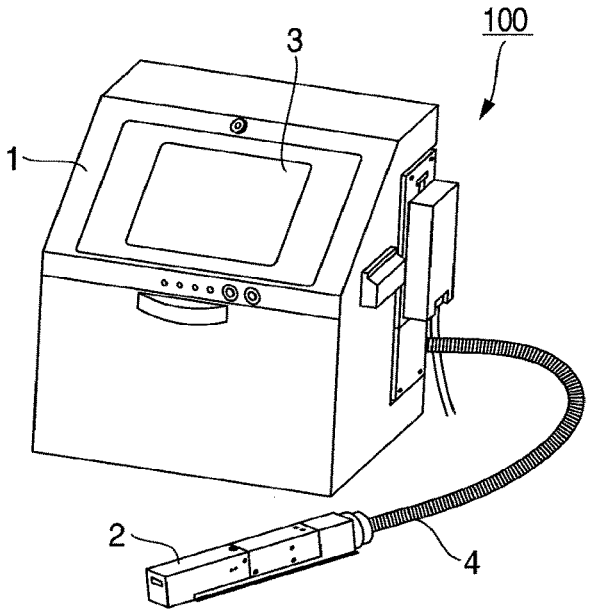
FIG. 1 is a diagram showing a perspective view of a main body of ink jet recording apparatus and outer appearance of a print head module.

A currently preferred embodiment of this invention will be described using examples illustrated in the accompanying figures of the drawing below. It should be noted that these illustrative examples are not to be construed as limiting the invention.

FIG. 1 is a perspective view of an ink jet recording apparatus 100 embodying the invention. The ink jet recording apparatus 100 is generally made up of a main body 1 and print head 2, with an operation display unit 3 being provided on an outer surface of the main body 3. The main body 1 and printhead 2 are connected together by a flexible conduit tube 4.

Figure 2:
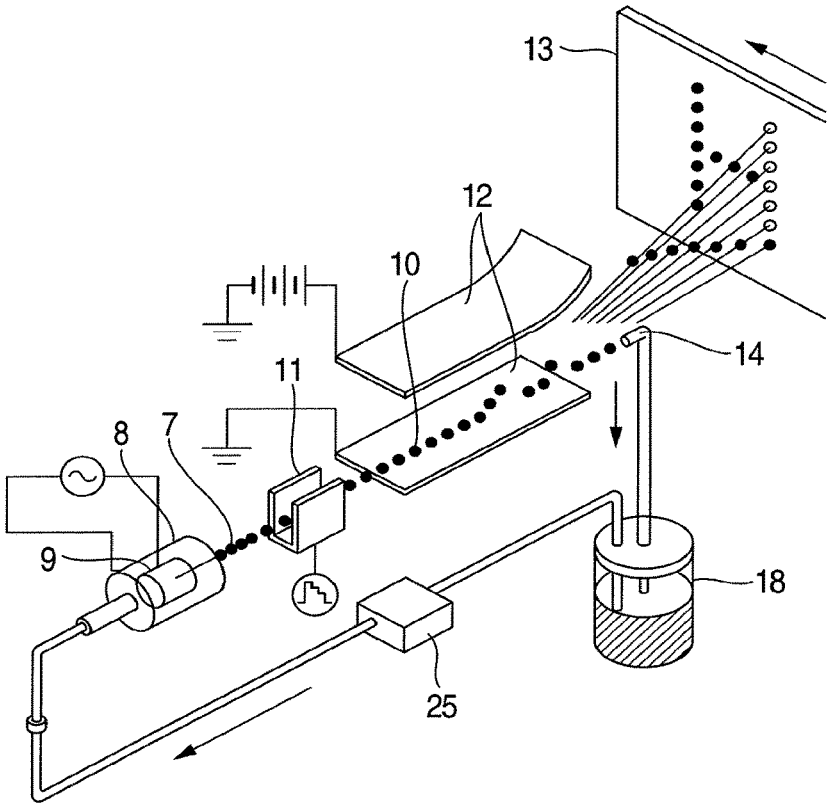
FIG. 2 is a perspective diagram of main components of the ink jet recording apparatus, for showing its principle of operation.

Here, an operation principle of the ink jet recording apparatus 100 will be explained. As shown in FIG. 2, the liquid ink stored in an ink container 18, also known as reservoir, is sucked and pressurized by a pump 25 so that a "jet" of ink 7 is ejected from a nozzle 8. The nozzle 8 has an electrostrictive element 9, which functions to apply vibrations of a predetermined frequency to the ink, thereby causing the ink jet 7 spouting from nozzle 8 to be broken into a continuous stream of tiny droplets 10. The number of these ink droplets 10 to be produced by this process is determined by the frequency of excitation voltage being applied to the electrostrictive element 9. The droplet number is substantially equal to the excitation voltage frequency.

The ink droplets 10 are given electrical charge by application of a voltage—its significance corresponds to print information—at a charging electrode 11. Each ink droplet 10 electrified at the charging electrode 11 exhibits deflection upon receipt of a force proportional to the amount of electrification during flying in an electrical field created between deflection electrodes 12, thereby behaving to fly toward a print object and then hit it. In this event, the ink droplet 10 is such that its impact position in the deflection direction varies depending on the amount of charge; further, by letting a production line cause a print object 13 to move in a direction at right angles to the deflection direction, it becomes possible to "shoot" droplets in the direction orthogonal to the deflection direction also, thereby forming impression of characters by multiple impact droplets, thus performing printing. Those ink droplets 10 that were not used for the printing are forced to fly straight between the deflection electrodes 12 and are captured by a gutter 14; thereafter, these are returned to the main ink reservoir 18 via a predetermined passageway and collected therein for reuse.

Figure 3:
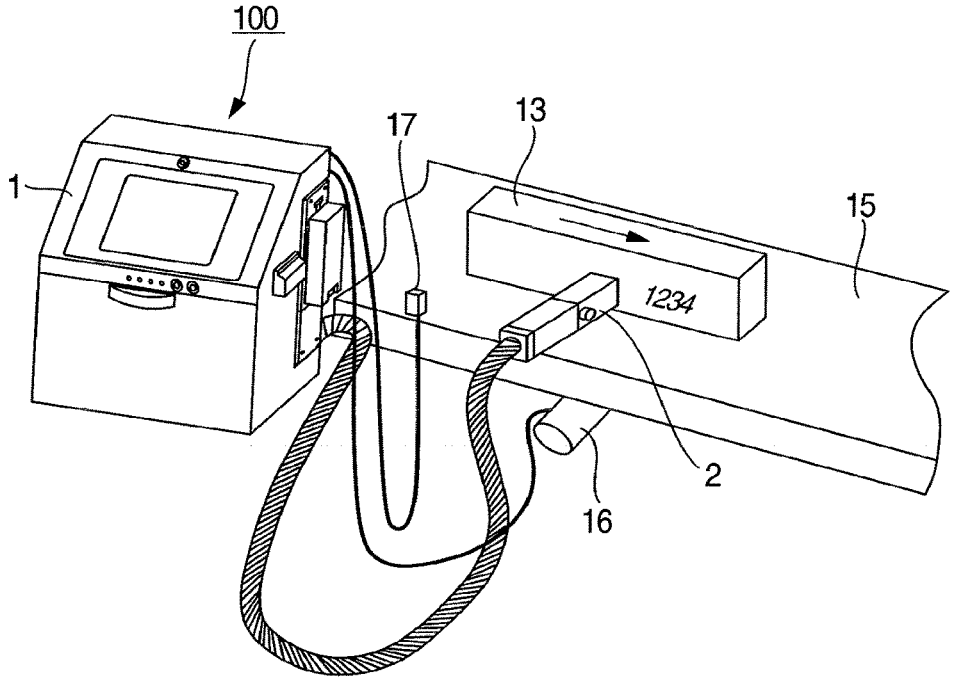
FIG. 3 is a perspective diagram showing an in-use state of the ink jet recording apparatus.

One example of the actual in-use state of the ink-jet recording apparatus 100 is shown in FIG. 3. The ink-jet recording apparatus 100 is installed at a production line in a factory or plant for manufacture of food articles, beverage products, etc. The printer's main body 1 is situated at a worker's operable position whereas the printhead 2 is placed at a position capable of approaching the print object 13 that is fed and sent fluently on the production line, such as a belt conveyer 15 or the like.

To perform printing while maintaining the same print width regardless of actual feed speeds on the production line such as belt conveyer 15 or else, there are provided an encoder 16 which outputs a signal appropriate for the feed speed to the ink-jet recording apparatus 100 and a print sensor 17 which detects the arrival of a print object 13 and outputs a signal for instructing ink-jet recording apparatus 100 to perform printing. Respective ones of them are connected to a control unit (not shown) which is built in the main body 1.

In response to such signals from the encoder 16 and print sensor 17, the control unit controls the timing and quantity of electrification to ink droplets 10 ejected from the nozzle 8, thereby causing charged/deflected ink droplets 10 to adhere to the print object 13 for completion of the printing while this object is passing by a nearby location of the printhead 2.

Figure 4:
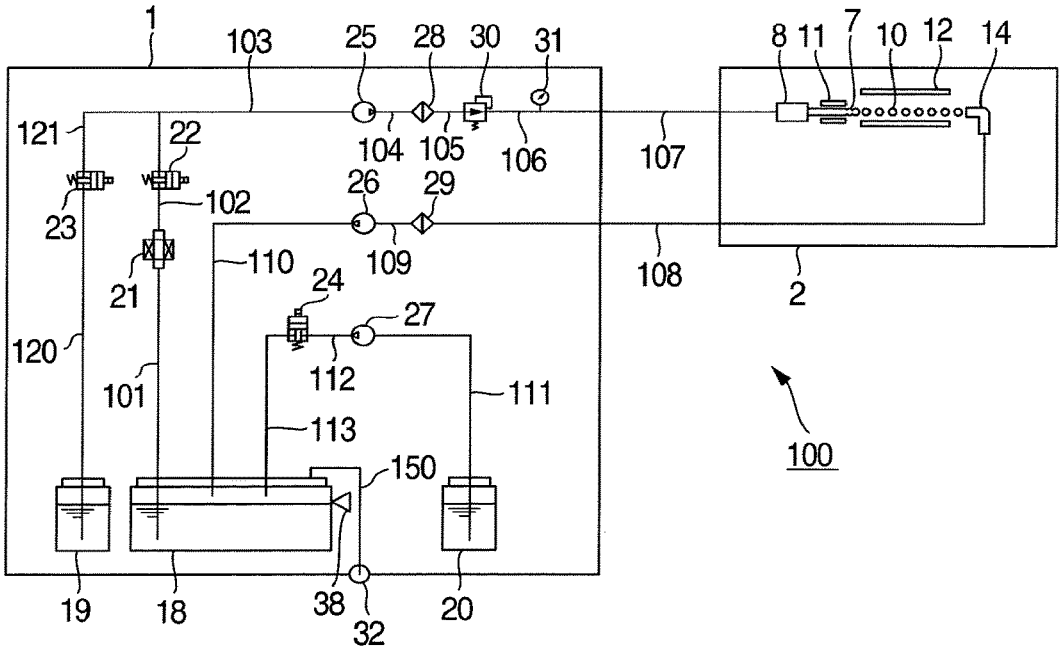
FIG. 4 is a diagram showing a configuration of circulation system passageways of the ink jet recording apparatus.

FIG. 4 is an explanatory diagram showing an overall passageway configuration of the ink-jet recording apparatus 100. The main body 1 is equipped with main ink reservoir 18 which holds a circulating flow of ink. This main ink reservoir 18 has a fluid level sensor 38 which detects whether or not the liquid inside main ink reservoir 18 reaches a reference liquid level indicating an amount adequate for internal storage of such liquid. Connected to the main ink reservoir 18 is a viscosity-measuring device 21, which may typically be a drop-type viscometer for measuring the viscosity of ink by way of a passageway 101 for ink circulation.

The viscometer 21 is connected via a pathway 102 to an electromagnetic valve 22 for opening/closing the pathway. This valve 22 is connected via a path 103 to pump 25 used for suction and pressure feed of the ink or solvent. This pump 25 is connected via a path 104 to filter 28 for removal of foreign material being mixed in the printer ink.

The filter 28 is connected via a path 105 to a decompression valve 30 for adjustment to a proper pressure in order to perform printing of the ink being pressure-fed from pump 25. This valve 30 is connected via a path 106 to a pressure sensor 31 for detection of an ink pressure.

The pressure sensor 31 is connected, via a path 107 extending through the interior of conduit tube 4, to the nozzle 8 having an ejection hole for expelling the ink stored in printhead 2.

In the ink ejection direction of the nozzle 8, the charging electrode 11 is disposed which forces a stream of ink droplets 10 ejected from the nozzle 8 to experience electrification with a charge amount adapted for the information of characters being printed. Placed in the flying direction of ink droplets 10 electrified by the charging electrode 11 are deflection electrodes 12 which create an electric field for deflecting the charged ink droplets 10.

On the deflection electrode 12's ink fly direction side, the gutter 14 is placed for capturing those ink droplets 10 which fly straight without experiencing electrification and deflection because these are unused for printing.

The gutter 14 is connected, via a path 108 penetrating the interior of conduit tube 4, to a filter 29 for removing foreign matter mixed in the ink stored in the main body 1. This filter 29 is connected via a path 109 to a collection pump 26 which sucks therein the ink droplets 10 captured by gutter 14. Then, collection pump 14 collects the sucked ink drops 10 via a path 110 and stores them in the main ink reservoir 18 for reuse.

The main body 1 has an exhaust port 32, which is connected to the main ink reservoir 18 via a path 150 for venting volatilized solvent components of the ink to the outside of main body 1.

The main body 1 is also equipped with a solvent container or "reservoir" 20 which holds therein a solvent for ink density adjustment and prevention of ink contamination occurring at the nozzle 8. The solvent reservoir 20 is connected via a path 111 to a pump 27 which performs suction and pressure feed of the solvent. This pump 27 is connected via a path 112 to an electromagnetic valve 24 for performing path-open/close operations. This valve 24 is connected to the main ink reservoir 18 via a path 113.

The main body 1 further includes an auxiliary ink container or reservoir 19 which holds ink for the refill use. The auxiliary ink reservoir 19 is connected via a path 120 to an electromagnetic valve 23 for opening/closing the path. This valve 23 is connected to the path 103 via a path 121.

Subsequently, an explanation will be given, using FIGS. 5A-5B, 6 and 7, of a method for resupplying the ink or solvent to the ink-jet recording apparatus having the ink/solvent reservoirs in accordance with the illustrative embodiment along with the outer appearance thereof.

Figure 5A:
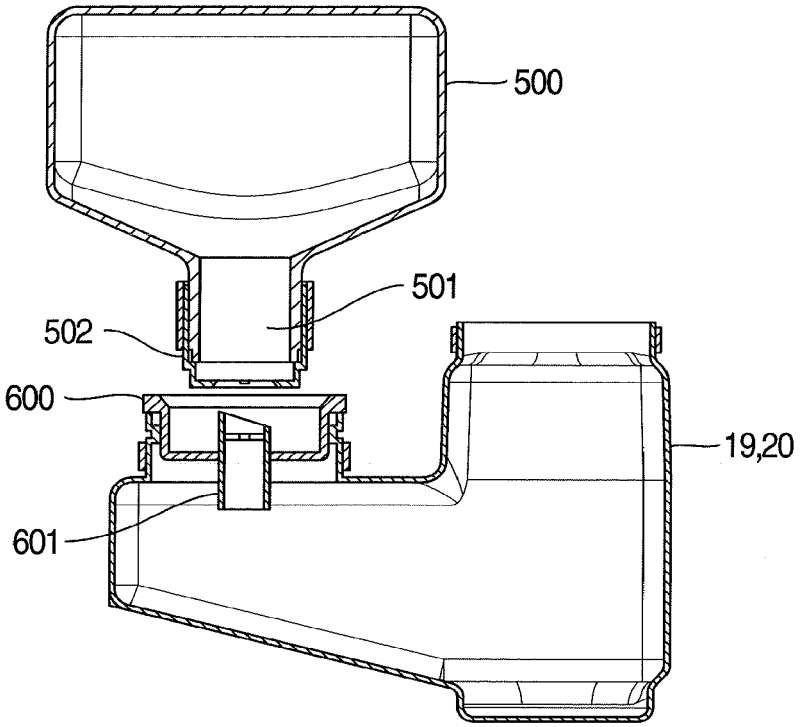
FIGS. 5A and 5B are diagrams each being for explanation of a procedure for re-supplying ink or solvent to the ink jet recording apparatus in accordance with one embodiment of this invention.
Figure 5B:
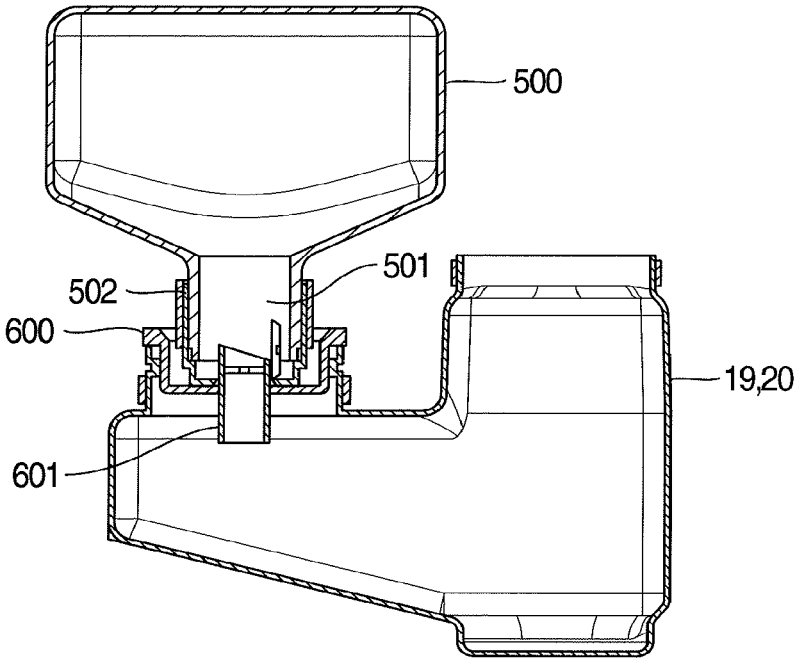

FIGS. 5A and 5B show one exemplary method of coupling together the auxiliary ink reservoir 19 or solvent reservoir 20 on the main body 1 side and a refill liquid container 500, wherein FIG. 5A is an example before coupling or engagement of the refill liquid container 500 whereas FIG. 5B is after engagement of refill liquid container 500. Suppose that the auxiliary ink reservoir 19 or solvent reservoir 20 is set in main body 1. Assume that a refilling operation is performed within the ink jet recording apparatus 100. Note that the auxiliary ink reservoir 19 and solvent reservoir 20 are the same in shape as each other; so, an explanation will here be given as to the auxiliary ink reservoir 19 only. Regarding the refill liquid container 500 also, its explanation will be given while assuming that this is coupled with the auxiliary ink reservoir 19 and used for an ink refill.

A structure of the refill liquid container 500 will first be described with reference to FIGS. 5A-5B. The refill liquid container 500 is filled with ink. A container cap 502 is attached in such a manner as to cover an opening 501 of refill liquid container 500. This cap 502 has its leading end surface which becomes a coupling face with auxiliary ink reservoir 19. As refill liquid container 500 has such cap 502, the ink or solvent does not spill out even when this refill container is set in the state that its opening 501 is directed downward prior to the refilling operation as shown in FIG. 5A; thus, it functions to prevent leakage of the ink or solvent in the interior of ink jet recording apparatus 100.

An explanation will next be given of the auxiliary ink reservoir 19 that is built in main body 1. At one end of auxiliary ink reservoir 19, a coupling member 600 is attached thereto, which is for engagement with the refill liquid container 500. This coupling member 600 has a pipe part 601 for causing the ink to flow into auxiliary ink reservoir 19. A detailed structure of coupling member 600 will be set forth later.

Subsequently, an operation of coupling together the auxiliary ink reservoir 19 and the refill liquid container 500 will be described. As shown in FIG. 5A, refill liquid container 500 is set in the state that its opening 501 faces downward at a position above the coupling member 600 and is then vertically inserted for engagement therewith. By joining them together as shown in FIG. 5B, the cap 502 is partly broken by pipe 601, thus enabling the ink in refill liquid container 500 to flow into auxiliary ink reservoir 19 for refilling. In this way, the illustrative embodiment is able to refill the ink or solvent by its own weight. This eliminates the use of an extra tube/pump kit, thereby enabling cost reduction.

Figure 6:
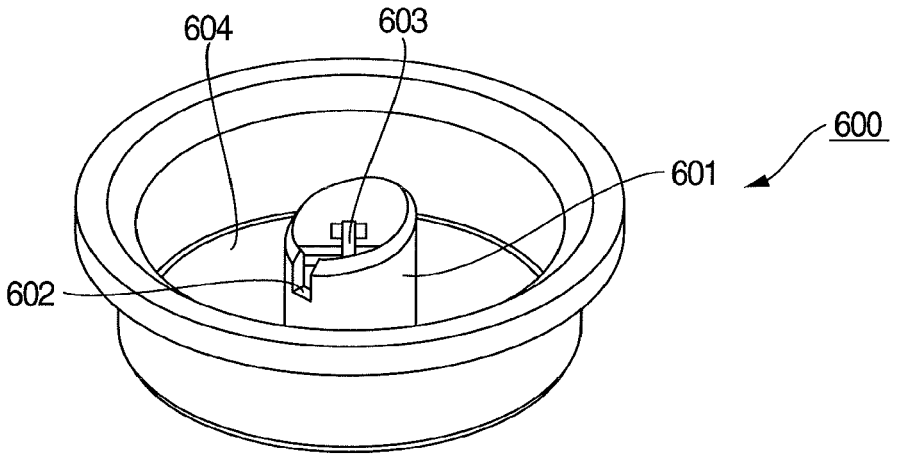
FIG. 6 is an equiangular diagram of a coupling member attached to an ink/solvent container in the embodiment apparatus.

A detailed structure of the coupling member 600 will next be explained with reference to FIG. 6. FIG. 6 shows a perspective view of outer appearance of the structure of coupling member 600. This coupling member 600 has at its central portion a pipe part 601 capable of guiding a liquid to flow therein. This pipe's leading end for penetrating or "piercing" the container cap 502 has an obliquely cut shape.

Additionally, the pipe 601 has a slit 602, which is formed at a lower end of the obliquely cut shape portion thereof. This is not for complete break-through of the container cap 502 upon penetration of cap 502 but for allowing a part of such broken end face to be left—i.e., remain unbroken—at the cap 502. Owing to this slit 602, it is possible to prevent the partly broken cap 502's cutaway fragment to fall down into the auxiliary ink reservoir 19 or solvent reservoir 20.

The pipe 601 has more than one cross-shaped rib 603 on its inner side. This is in view of the fact that upon penetration of the cap 502 by pipe 601, pipe 601 must support the weight of refill liquid container 500 so that a corresponding load is applied thereto. As a structure capable of withstanding this load, the rib 603 is provided. An increase in number of ribs would result in a likewise increase in strength against the load at the time of coupling; however, in such case, the ink/solvent flow passage becomes narrower, thus making it difficult to perform smooth resupplying of the ink or solvent to the auxiliary ink reservoir 19 or solvent reservoir 20. To avoid this, the rib 603 is arranged to have a cross-like shape to thereby enhance mechanical/physical strength while simultaneously minimizing hindrance to the ink's inflow activities in ink-refilling events. To secure the load-bearable strength, the rib 603 is preferably formed at an upper end of the pipe 601. In this embodiment, rib 603 is the same in level as the slit 602.

The coupling member 600 has a concave shape. Its depression defines a tray-like portion 604. By this tray 604, it is possible to stably hold the refill liquid container 500 when being joined therewith. The aforesaid pipe unit 601 is provided at the center of a top surface of this tray 604; pipe 601 extends in outward and inward directions of auxiliary ink reservoir 19 when viewing from the surface of tray 604.

The coupling member 600 is made of molded resin. To lessen the penetration force needed to "pierce" the container cap 502, use of a metal is preferable for amelioration of the efficiency. However, this poses a risk of electrostatically occurrable flash ignition since the ink or solvent is stored in auxiliary ink reservoir 19 or solvent reservoir 20. Consequently, the "piercing" unit 600 of this embodiment is designed as a resin-molded component.

Figure 7:
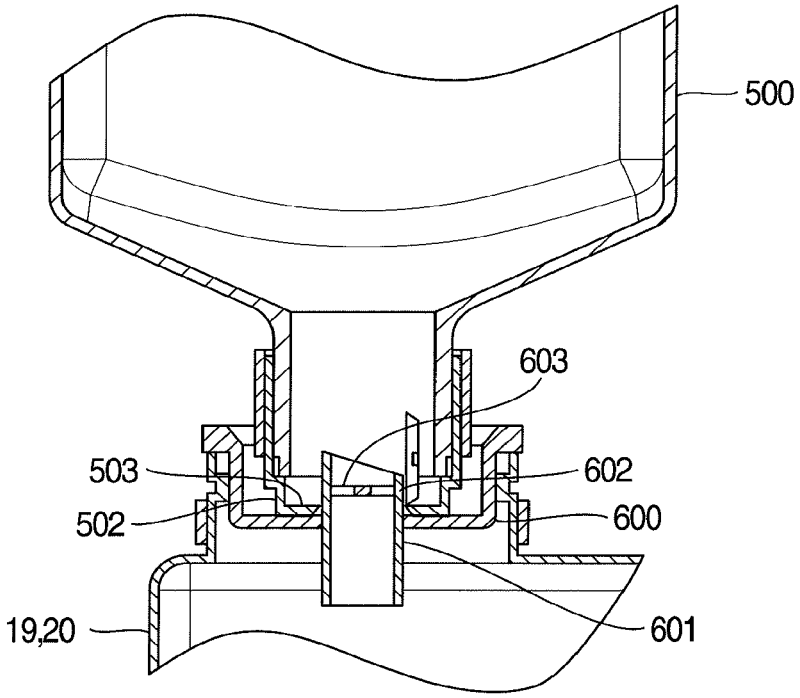
FIG. 7 is an enlarged cross-sectional diagram of the coupling unit for engaging together a refill liquid container and the ink/solvent container in the embodiment apparatus.

FIG. 7 is an enlarged sectional view of the coupling unit for engagement between the refill liquid container 500 and auxiliary ink reservoir 19. In the coupled state, a certain amount of liquid is left on the inner face 503 of container cap 502 to a level corresponding to the height that the pipe 601 smashes through cap 502 to be inserted into refill container 500. To minimize such residual liquid, it is possible by the slit 602 to additionally supply the liquid being left on the container cap's inner face 503 to the auxiliary ink reservoir 19 or solvent reservoir 20. Due to this, the length of slit 602 varies depending on the position of cap 502.

Although in this embodiment one specific structure was explained for establishing engagement by letting the pipe 601 penetrate refill liquid container 500, other similar suitable structures are also implementable. One exemplary structure is such that the refill container is modified to have an openable/closable lid, which is driven by the pipe 601 to open to thereby permit inflow of the liquid. With this structure also, it is possible to reduce or minimize the residual liquid in the refill container owing to the presence of a slit in the pipe 601 being inserted into the refill container.

With the structures stated above, it is possible to provide the intended liquid container capable of reducing a residual liquid in a refill container being coupled therewith and an ink jet recording apparatus having it.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A coupling member comprising:

a pipe unit;

a cross-shaped rib; and a flat part which forms a concave shaped portion that is joined to an end part of the pipe unit, wherein the pipe unit breaks through a container cap of a liquid container having the container cap attached in such a manner as to cover an opening, the pipe unit is inserted into the liquid container to enable a liquid inside the liquid container to flow into the coupling member side via the pipe unit, the cross-shaped rib is disposed inside of the pipe unit, one portion of an end of the pipe unit extends longitudinally further than a rest of the end of the pipe unit, and the pipe unit defines a slit, the slit having a length that is shorter than a length of the pipe unit.

2. The coupling member according to claim 1, wherein the pipe unit is inserted upward in a vertical direction into the liquid container.

3. The coupling member according to claim 1, wherein the coupling member is made of molded resin.

4. A refillable liquid system, comprising:

a liquid container; and a coupler that is structurally configured to pierce through the liquid container, wherein the coupler includes:

a pipe unit, a cross-shaped rib, and a flat part which forms a concave shaped portion that is joined to an end part of the pipe unit, wherein the pipe unit breaks through a container cap of a liquid container having the container cap attached in such a manner as to cover an opening, the pipe unit is inserted into the liquid container to enable a liquid inside the liquid container to flow into a coupling member side via the pipe unit, the cross-shaped rib is disposed inside of the pipe unit, one portion of an end of the pipe unit extends longitudinally further than a rest of the end of the pipe unit, and the pipe unit defines a slit, the slit having a length that is shorter than a length of the pipe unit.

5. The coupling member according to claim 1, wherein the cross-shaped rib has a base portion that extends along a longitudinal direction of the pipe unit.

6. The refillable liquid system according to claim 4, wherein the cross-shaped rib has a base portion that extends along a longitudinal direction of the pipe unit, the cross-shaped rib being disposed inside of the pipe unit, adjacent to an open end defined by the pipe unit, such that the cross-shaped rib does not perforate the pipe unit.

* * * * *